US008443933B2

(12) United States Patent
Pfeffer et al.

(10) Patent No.: US 8,443,933 B2
(45) Date of Patent: May 21, 2013

(54) TUBULAR ACOUSTIC INSULATING ELEMENT

(75) Inventors: Tobias Pfeffer, Edenkoben (DE); Bernd Fuhrmann, Edenkoben (DE)

(73) Assignee: Tenneco GmbH, Edenkoben (DE)

( * ) Notice: Subject to any disclaimer, the term of this patent is extended or adjusted under 35 U.S.C. 154(b) by 0 days.

(21) Appl. No.: 13/380,067

(22) PCT Filed: Jun. 23, 2010

(86) PCT No.: PCT/EP2010/058952

§ 371 (c)(1),
(2), (4) Date: Mar. 15, 2012

(87) PCT Pub. No.: WO2010/149723

PCT Pub. Date: Dec. 29, 2010

(65) Prior Publication Data

US 2012/0160600 A1 Jun. 28, 2012

(30) Foreign Application Priority Data

Jun. 23, 2009 (DE) ..... 10 2009 030 258

(51) Int. Cl.
*F01N 1/24* (2006.01)

(52) U.S. Cl.
USPC ..... 181/256; 181/227; 181/228

(58) Field of Classification Search
USPC ..... 181/256, 227, 228
See application file for complete search history.

(56) References Cited

U.S. PATENT DOCUMENTS

| | | | | | |
|---|---|---|---|---|---|
| 3,903,928 | A | * | 9/1975 | Sykes et al. | 138/109 |
| 4,315,558 | A | * | 2/1982 | Katayama | 181/227 |
| 4,458,722 | A | * | 7/1984 | Dahn | 138/121 |
| 4,867,269 | A | * | 9/1989 | Lalikos et al. | 181/207 |
| 5,456,291 | A | | 10/1995 | Kunzmann | |
| 6,062,268 | A | * | 5/2000 | Elsasser et al. | 138/121 |
| 6,705,429 | B2 | * | 3/2004 | Kaku et al. | 181/227 |
| 7,458,440 | B2 | * | 12/2008 | Uegane | 181/228 |

FOREIGN PATENT DOCUMENTS

| | | | | |
|---|---|---|---|---|
| DE | 198 12 611 | A1 | | 10/1999 |
| DE | 202004005526 | U1 | | 8/2004 |
| DE | 102006040980 | A1 | | 3/2008 |
| EP | 1319826 | A1 | | 6/2003 |
| EP | 1431538 | A1 | | 6/2004 |
| JP | 60247005 | A | * | 12/1985 |
| JP | 09089173 | A | | 3/1997 |
| WO | 03056151 | A1 | | 7/2003 |

* cited by examiner

*Primary Examiner* — Forrest M Phillips
(74) *Attorney, Agent, or Firm* — Hudak, Shunk & Farine Co. LPA

(57) ABSTRACT

An exhaust system composed of a plurality of components for an internal combustion engine for connecting to a manifold, the exhaust system includes at least one first section, which is provided indirectly or directly after the manifold in the flow direction, and a second section, which is directly adjacent thereto in the flow direction, wherein the two sections are connected to each other by a mechanical decoupling element. The resonant oscillations in the range above 600 Hz are to be attenuated in the exhaust system by more than 15 dB and, at the same time, the exhaust system is to be sufficiently rigid and self-supporting and designed to be lastingly gas-tight. For this purpose, a single-walled arid self-supporting acoustic insulating element is integrated in the exhaust system in the flow direction upstream of, or in, the first section.

18 Claims, 3 Drawing Sheets

TUBULAR ACOUSTIC INSULATING ELEMENT

FIELD OF THE INVENTION

The invention relates to an exhaust gas system for an internal combustion engine to be connected to a manifold. The exhaust gas system consists of at least one first section provided in the direction of flow directly or indirectly downstream of the manifold, and of a second section following it in the direction of flow with the two sections being interconnected via a mechanical de-coupling element.

BACKGROUND OF THE INVENTION

The exhaust gas system Is mechanically de-coupled by means of the de-coupling element for providing a certain degree of flexibility over the length of the vehicle. As mechanical de-coupling elements non-self-supporting, flexible connecting elements, such as corrugated tubes or flexible, tubes are, inserted between two sections of the exhaust gas system. Due to the fact that the corrugated tubes or flexible tubes are hot self-supporting, they must be supported. Owing to their small degree of stiffness and flexibility, they have also the inherent property of absorbing to a certain extent vibrations in certain frequency ranges. Such flexible sound-absorbing insulating elements are described for instance in U.S. Pat. No. 5,456,291 A and in EP 1 431 538 B1.

For a mechanical articulated de-coupling of two pipe flanges or casing flanges of an exhaust gas system which permits a relative bending of the exhaust gas system, also jolted connecting elements which have a joint-like flexibility are inserted between two sections. These de-coupling elements which are described in DE 198 12 611 C2 or in JP 199789173 A (Hei9-89173) are shaped as a jolted pipe length which forms in the longitudinal section an S-shaped spring. Owing to the reduced wave shape the said connecting elements are stiff when compared to the corrugated tubes; they are, however, self-supporting. In order to increase their flexibility they can be provided with a longitudinal slot according to DE 198 12 611 C2.

It is known that due to most different modern construction methods for exhaust gas systems and internal combustion engines, an increasing number of vibrations in the audible range are caused, in spite of a mechanical de-coupling, by resonance in different components. Flatter forms of mufflers, the use of thin-wall, ventilation-slot-insulated sheet metal manifolds and turbochargers in diesel engines as well as changes in the combustion process result in additional vibrations in the structures and thus in additional solid-borne vibrations.

This kind of solid-borne vibration may be reduced directly in the structures by means of sound-absorbing insulating elements in the exhaust gas system or also by great impedance leaps in components of an exhaust gas system.

According to DE 10 2006 040 980 A1 impedance leaps are achieved with a sound-absorbing insulating element provided with radial widenings of the cross-section which are attached onto the pipe like a pipe clamp.

In DE 20 2004 005 526 U1 a rigid flanged joint is described for the reduction of solid-born vibrations which muffles the transmission of vibrations by means of a line-shaped structure in the circumferential direction around the pipe axis or flange axis.

SUMMARY OF THE INVENTION

The object of the invention is to muffle resonance vibrations within the range above 600 Hz in an exhaust gas system by more than 15 dB and to provide at the same time ah exhaust gas system which is sufficiently rigid and self-supporting as well as permanently gas-proof.

The object is accomplished by the integration, in combination with a mechanical de-coupling elements of a single-wall and self-supporting sound-absorbing insulating element into the exhaust gas system in flow direction upstream of or within the first section, with the sound-absorbing insulating element being provided with at least an internal connecting sleeve and with at least one external connecting sleeve offset to the outside in a direction radial to a central axis, with a central section longitudinally shortened in the direction of the central axis being provided that is arranged between the two connecting sleeves and connects the two connecting sleeves, with the cross-section of the said central section forming a U or S eccentricity.

It was found out through sound measurements that the known flexible and self-supporting mechanical de-coupling elements in the form of a shortened pipe length with an S eccentricity in the frequency range above 600 Hz, in particular from 3,000 Hz to 6,000 Hz, have sound-absorbing insulating properties which were not to be expected that reduce to a considerable extent the interactions in the other sections of the exhaust gas system and the generation of solid-borne vibrations. The geometric and constructive measures taken with a view to achieving a greatest possible damping resulted in the finding that very good damping properties can be achieved even with a comparatively rigid and self-supporting configuration of the S shaped de-coupling element.

In this context it is advantageous to configure the tube-shaped sound-absorbing insulating element in the direction of the central axis as short as possible thereby accomplishing a flexural rigidity adequate for its use as a self-supporting sound-absorbing insulating element. In the region where the sound-absorbing insulating element is integrated into the exhaust gas system it need not function as a mechanical de-coupling element and may have a relative flexural rigidity.

Here, it may also be of importance that the push-in depth is in the range from 5 mm to 16 mm, maximally 30 mm.

In accordance with the invention the insulating property can be further improved when the sound-absorbing insulating element is connected directly upstream of or to the component which in the last analysis generates the resonance in the transmitting components. The internal radius and the external radius have advantageously a size from 6 mm to 30 mm with both radii having, however, a different size in relation to each other.

In this connection it may also be advantageous when the internal connecting sleeve in the direction of the central axis is positioned offset to the external connecting sleeve and/or when the two connecting sleeves overlap each other by the size of a push-in depth e from 5 mm to 30 mm. The length of the push-in depth e is the measure by which the external connecting sleeve in the direction of the central axis projects beyond the internal connecting sleeve. For the said length, both the pipe length that is provided between the internal radius and the external radius and the two radii themselves are to be taken into account for the size of the push-in depth e. The shorter the push-in depth e, the greater the sound-absorbing insulation which is accomplished with the element.

Moreover, it is advantageous that the basic diameter of the internal connecting sleeve is smaller by at least 20% to maximally 40% than the diameter of the external connecting sleeve. The sound-absorbing insulation can be essentially influenced by the two end geometries of the two connecting sleeves since the vibration behaviour distinctly deviates in the event of transmission from a small to a larger connecting sleeve from the vibration behaviour which would be attained when the internal connecting sleeve as intake connecting sleeve would have the same size as the external connecting sleeve as exhaust connecting sleeve.

As far as the insulating properties are concerned, it may also be advantageous when a central section which connects the two tube-shaped connecting sleeves is provided with at least one external radius connected at the external connecting sleeve and one internal radius connected at the internal connecting sleeve as well as a pipe length connecting the two radii, with the pipe wall of the pipe length being arranged in parallel to or in an angle a between 2.5° and 15° to the central axis. This additional possibility of influencing the insulating effect offers also the advantage that in the presence of a connecting geometry for the internal connecting sleeve or for the external connecting sleeve the size of the two radii can be varied, i.e. that with very small radii this pipe length includes an increasingly larger angle a to the central axis. Another advantage is that the connecting geometry can be enlarged or reduced by the variation of angle a both for the internal connecting sleeve and for the external connecting sleeve.

In this connection it can also be advantageous when the single-wall sound-absorbing insulating element is made of sheet metal or cast metal and the insulating element is provided in a direction along the work piece with continuously or discontinuous increasing wall thicknesses ranging from 1 mm to 2.8 mm, in particular ranging from 1.2 mm to 1.9 mm. The insulating effect which is achieved by means of a decreasing Wall thickness has an advantageous effect in particular in the frequency range over and above 2,000 to 6,000 Hz. This is advantageous in particular insofar as when the diameter of the external connecting sleeve is adjusted from a smaller to a larger size the wall thickness does anyhow become thinner. Consequently, a cylindrical pipe with a basic diameter matching the internal connecting sleeve on the exhaust side would be adjusted up to the size of the diameter for the external connecting sleeve.

In addition it may be advantageous when the sound-absorbing insulating element has in the flow direction S downstream of the internal connecting sleeve a reduced internal diameter when compared to the basic diameter. By means of this measure, a kind of taper in the passage from the internal connecting sleeve to the central section is formed, by which in particular the vibrations which exist in the exhaust gas pipe are influenced in respect of the insulation.

It may be of particular importance for the present invention When the sound-absorbing insulating element is made of an adjusted pipe length with a basic diameter on the intake side from 45 mm to 85 mm and a diameter on the exhaust side from 55 mm to 115 mm as well as with an absolute length in the direction of the central axis from 230 mm to 420 mm. The ratio of basic diameter to diameter sub-stantially influences the insulating property of the element.

In connection with the inventive configuration and arrangement it may be advantageous when the sound-absorbing insulating element is integrated into an end wall of a sheet metal housing for a filter or a converter or a muffler with at least a part of the end wall connecting in a radial direction to the central axis to the internal connecting sleeve, and/or to the external connecting sleeve. This facilitates the integration of the insulating element, into a component that is present in the exhaust gas systems and to which an exhaust gas pipe would anyhow be connected. Moreover, the integration into an end wall offers the advantage that the overall length and thus also the rigidity of the element can be increased which has an essential impact on the insulating property.

Furthermore, it can be advantageous when the sound-absorbing insulating element, is positioned at an outlet of a housing for a turbocharger. Since turbo-chargers make, a comparatively great contribution to the solid-borne vibration which is generated in the exhaust gas system within the range from 600 Hz to 6 kHz, a positioning of such ah insulating element directly downstream of the turbocharger is of great importance, and by means of such a positioning the greater diameter adjusted in the area of the external connecting sleeve can be more easily integrated into the geometry of ah exhaust gas system because this external connecting sleeve is connected directly to the housing, and a possibly required reduction of the diameter again down to the size of the diameter that is provided for the other exhaust gas pipes which corresponds to the internal connecting sleeve is not necessary.

Furthermore, the use of a mechanical de-coupling element for an exhaust gas system for the sound-absorbing insulation of an exhaust gas system within the frequency range from 600 Hz to 6 kHz can be advantageous when the sound-absorbing insulating element is provided with at least one internal connecting sleeve and at least one external connecting sleeve offset to the outside in a direction radial to a central axis, with a shortened central section being provided that is arranged between the two connecting, sleeves and connects the two connecting sleeves, with the cross-section of the said central section forming a U or S eccentricity.

BRIEF DESCRIPTION OF THE DRAWINGS

Further advantages and details of the invention are explained in the patent claims and in the description and are shown in the figures in which

DETAILED DESCRIPTION OF THE INVENTION

Figure 1:
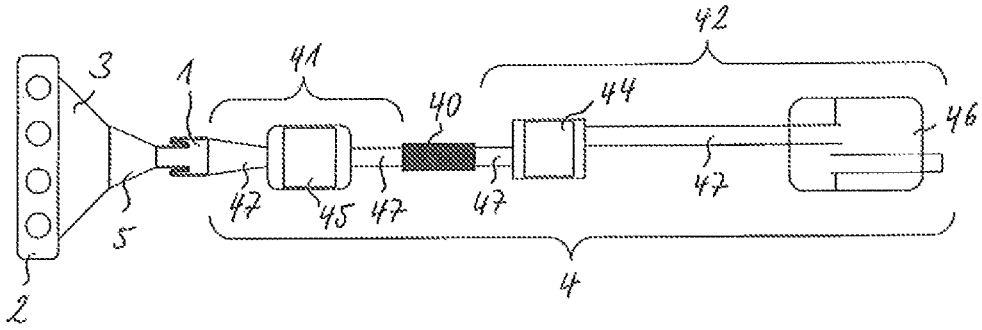
FIG. 1 shows an exhaust gas system connected to ah engine.

FIG. 1 shows an exhaust gas system 4 consisting of a first section 41 and a second section 42. The first section 41 is formed by a converter 45 and exhaust gas pipes 47 connected on both sides of converter 45. The second section 42 consists of a particulate filter 44 and a muffler 46, with the particulate filter 44 and the muffler 46 being interconnected via an exhaust gas pipe 47. Upstream of the particulate filter 44 there is also provided an exhaust gas pipe 47 to which a mechanical de-coupling element 40 is connected which interconnects the two sections 41, 42. The purpose of the mechanical de-coupling element 40 is essentially to guarantee a certain freedom of movement of the exhaust gas system 4 over its entire length.

The entire exhaust gas system 4 is connected via a sound-absorbing insulating element 1 to an outlet opening of a turbocharger 5 which connects the exhaust gas system 4 via the manifolds 3 with the internal combustion engine 2. The vibrations which are supplied into the exhaust gas system 4 via the exhaust gas flow and the turbocharger 5 are substantially damped via the sound-absorbing insulating element 1 within the range from 600 Hz to 6 kHz so that the solid-borne emissions of converter 45, of particulate filter 44 and of muffler 46 are reduced. At the same time, the vibrations that are still present in the first section 41 of the exhaust gas, system 4 are also influenced and also partially damped by the mechanical de-coupling element 40 so that the combination of the sound-absorbing insulation with the insulating element 1 and the damping of vibration with the mechanical de-coupling element 40 brings about a reduction of the solid-borne vibration within the second section 42 of exhaust gas system 4.

Figure 2:
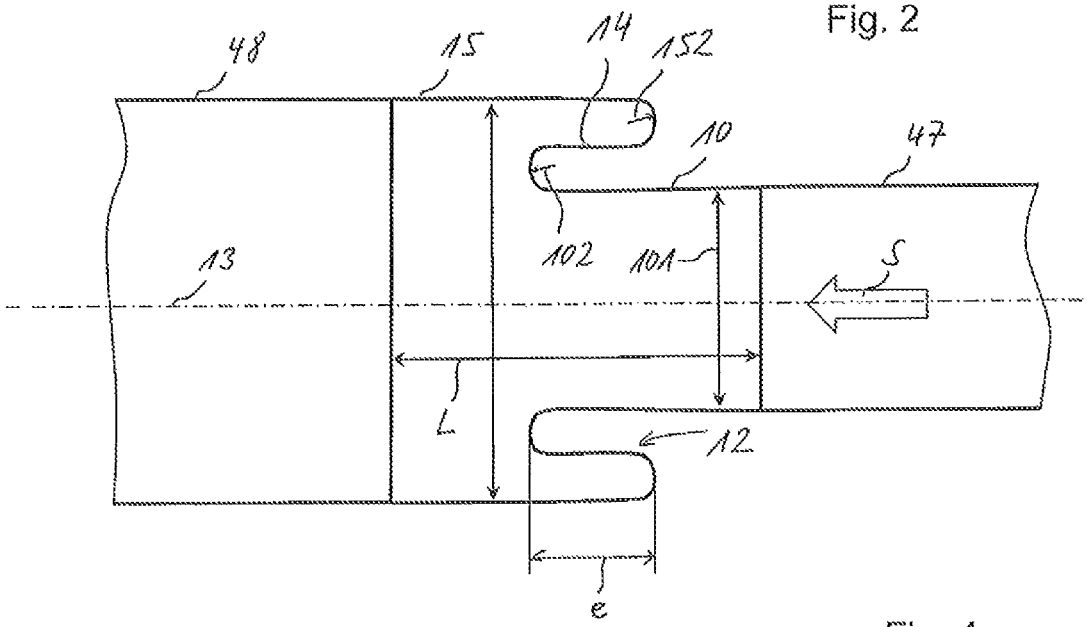
FIG. 2 shows a cross-section of an insulating element which is integrated between two components of an exhaust gas system.

FIG. 2 shows a schematic cross-section of a sound-absorbing insulating element 1 with an S eccentricity 120. The sound-absorbing insulating element 1 is provided with an internal connecting sleeve 10 and an external connecting sleeve 15 in a radial direction to the central axis 13. The external connecting sleeve 15 projects in the axial direction to the central axis 13 beyond the internal connecting sleeve 10, The connection of the external connecting sleeve 15 with the internal connecting sleeve 10 forms a central section 12 with an S eccentricity 120 in the cross-section. The central section 12 is formed by the external radius 152 connected to the external connecting sleeve 15 and the internal radius 102 connected to the internal connecting sleeve, 10 as well as by a pipe length 14 which connects the two radii 102, 152.

The projection of the external connecting sleeve 15 beyond the internal connecting sleeve 10 is termed push-in depth e the total of which is made up by the size of the pipe length 14 and the two radii 102, 152. The length L of the insulating element 1 in the direction of the central axis 13 is measured from the intake opening at the internal connecting sleeve 10 up to the exhaust opening at the external connecting sleeve 15.

As is shown in FIG. 2, an exhaust gas pipe 47 connects to the internal connecting sleeve 10 in the flow direction S upstream of the insulating element 1. In the flow direction S downstream of the insulating element 1 a schematically shown exhaust gas element 48 is connected to the insulating element 1. In FIGS. 5 to 8, examples of such exhaust gas elements 48 are shown by sheet metal housings 43.

The S eccentricity 120 can have, in different embodiments which are not shown, a basic diameter 101 at the intake side ranging from 45 mm to 85 mm and a diameter 151 at the exhaust side ranging from 55 mm to 115 mm as well as an absolute length L in the direction of the central axis 13 ranging from 230 mm to 420 mm, where the ratio of the diameters 101, 151 and of the length L can be selected in such a manner that the natural frequency at a medium input frequency a) of 350 Hz amounts to a medium axial transmission loss of at least −18 dB and
b) of 600 Hz amounts to a medium axial transmission loss of at least 0 dB and
c) of 1,000 Hz amounts to a medium, axial transmission loss of at least 8 dB and
d) of 3,000 Hz amounts to a medium axial transmission loss of at least 20 dB.

With these parameters of the geometry the natural frequency can be shifted when compared to a cylindrical exhaust gas pipe within the range from 400 Hz to 700 Hz, with a positive damping being achievable as from 600, Hz or as from 900 Hz. Moreover, a maximum damping of 30 dB can be achieved in the range from 600 Hz to 6 kHz.

Figure 3:
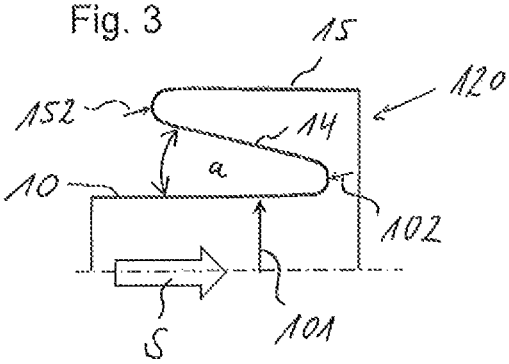
FIG. 3 shows an upper section of a cross-section of an insulating element with an internal diameter that is reduced when compared to the basic diameter.

FIG. 3 shows a special embodiment of the S eccentricity 120 where the pipe length 14 which is provided between the two radii 102, 152 is positioned opposite the central axis 13 by an angle a. It can be seen that the pipe length 14 is thus not positioned in parallel to the central axis 13 as is shown for instance in FIG. 3. Through the variation of the angle a both the basic diameter 101 of the internal connecting sleeve 10 and the diameter 151 of the external connecting sleeve 15 can be varied in relation to each other. In particular in the event, when the sound-absorbing insulating element 1 is made from a cylindrical pipe and adjusted which has essentially a pipe diameter that Corresponds to the basic diameter 101 of the internal connecting sleeve 10, the external connecting sleeve 15 is adjusted by a specific size. In accordance with the required geometrical sizes and with a view to the wall thickness which is essential for the external connecting sleeve 15, the diameter 151 of the external connecting sleeve 15 can be varied by means of the variation of angle a, in particular when the internal and the external radius 102, 152 are to have, a fixed size. Also in this embodiment the push-in depth e is decisive through the size of the two radii 102, 152 and the length L of the pipe length a in the direction of the central axis 13.

Figure 4:
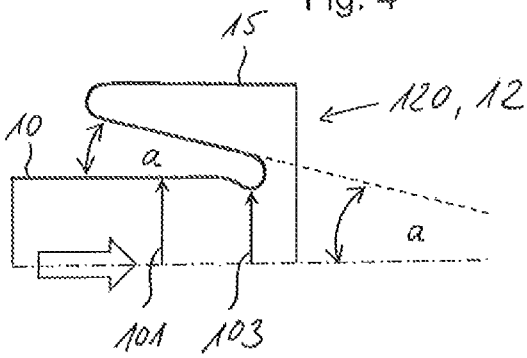
FIG. 4 shows a cross-section of an insulating element with a pipe section positioned opposite the central axis.

When compared to FIG. 3, FIG. 4 shows a modified embodiment in which Within the area of the internal radius 102 the internal diameter 103 is reduced when compared to the basic diameter 101 of the internal connecting sleeve 10. In flow direction S a compression of the exhaust gas flow is thus achieved, and, at the same time, influence is exerted on the acoustic waves inside the internal connecting sleeve 10.

Figure 5:
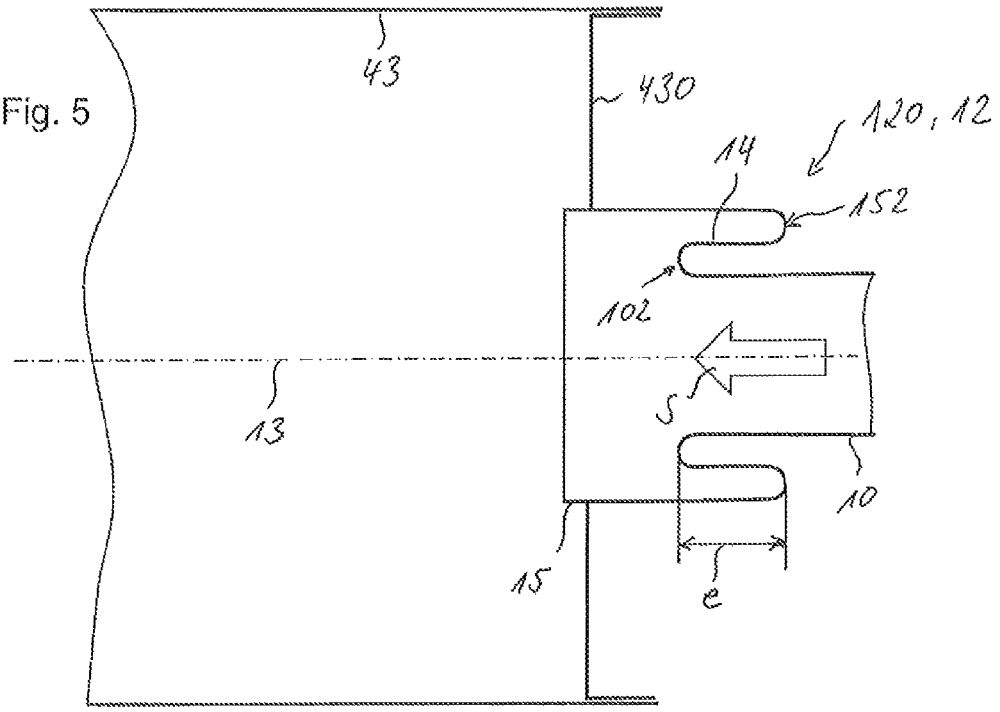
FIG. 5 shows the integration of an insulating element into an end wall of a housing.

FIG. 5 shows a preferred embodiment where the sound-absorbing insulating element 1 is integrated into an end wall 430 of a sheet metal housing 43 of an exhaust gas system 4. In particular in spun mufflers the end wall 430 is inserted in the direction of the central axis 13 into the sheet metal housing 43 so that the mounting of the insulating element 1 into the end wall 430 is possible prior to the winding of the housing. For this purpose, the sound-absorbing insulating element 1 with the external connecting sleeve 15 is welded into a corresponding opening of the end wall 430. The diameter 151 of the external connecting sleeve 15 which is considerably larger than that of the internal connecting sleeve 10 practically forms the exhaust side for the exhaust gas that is flowing in the flow direction S so that the exhaust gas and/or the exhaust gas flow further propagate downstream of the sound-absorbing insulating element 1 in the sheet metal housing 43 in radial direction. This offers also the advantage that by means of a reduction of the diameter 151 of the external connecting sleeve 15 in the event of a continuation within the exhaust gas pipe which has approximately the same diameter as the internal connecting sleeve 10, a decrease of the cross-sectional area can be avoided.

Figure 6:
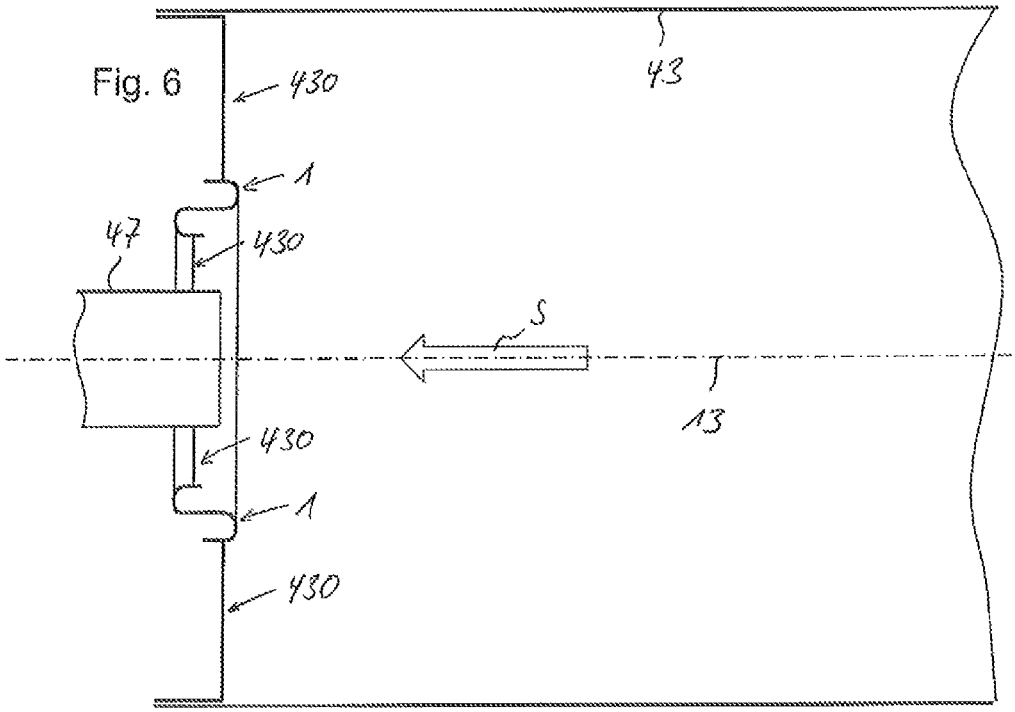
FIG. 6 shows, a configuration according to FIG. 5 where the insulating element is positioned in a radial direction centrally to the end wall.

FIG. 6 shows an embodiment similar to that in FIG. 5 as far as the positioning within ah end wall 430 of a sheet metal housing 43 is concerned. In this ease, the S shaped sound-absorbing insulating element 1 is, however, positioned in a radial direction to the central axis 13 approximately in the centre of the end wall 430 so that, starting from the exhaust gas pipe 47 that is mounted in the end wall 430, at first a first section of the end wall 430 in the radial direction forms a connection to the sound-absorbing insulating element 1 and, following the sound-absorbing insulating element 1 in the radial direction, a second section of the end wall 430 forms the joint and the connection to the circumferentially arranged sheet metal housing 43. In this embodiment the internal connecting Sleeve 10 and the external connecting sleeve 15 are extremely short and the adjoining components are hot arranged, as in the preceding embodiments, in an axial direction to the central axis 13 adjoining the sound-absorbing insulating element 1 but in radial direction.

Figure 7:
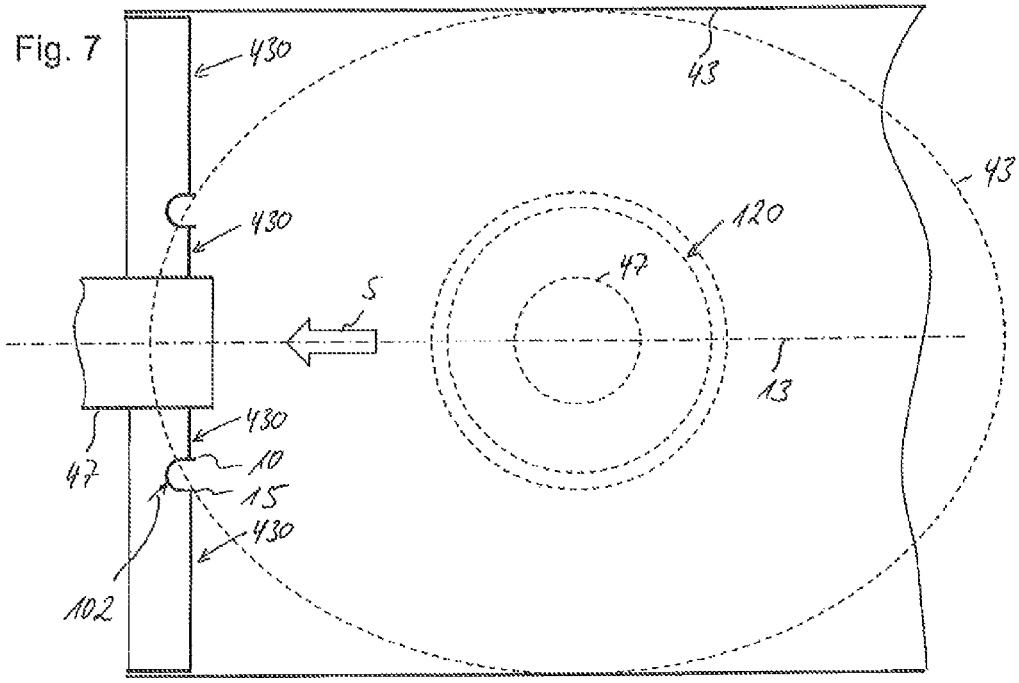
FIG. 7 shows a configuration according to FIG. 6 where the insulating element has a U eccentricity.

FIG. 7 shows an embodiment similar to that in FIG. 6 where the sound-absorbing insulating element 1 does not have an S shaped cross-section but a U shaped cross-section 120. The U shaped sound-absorbing insulating element 1 is provided with one radius only that is termed internal radius 102 and can, due to the existing geometry, be used exclusively in those regions where the other components follow the, sound-absorbing insulating element 1 in the radial direction to the central axis 13.

Figure 8:
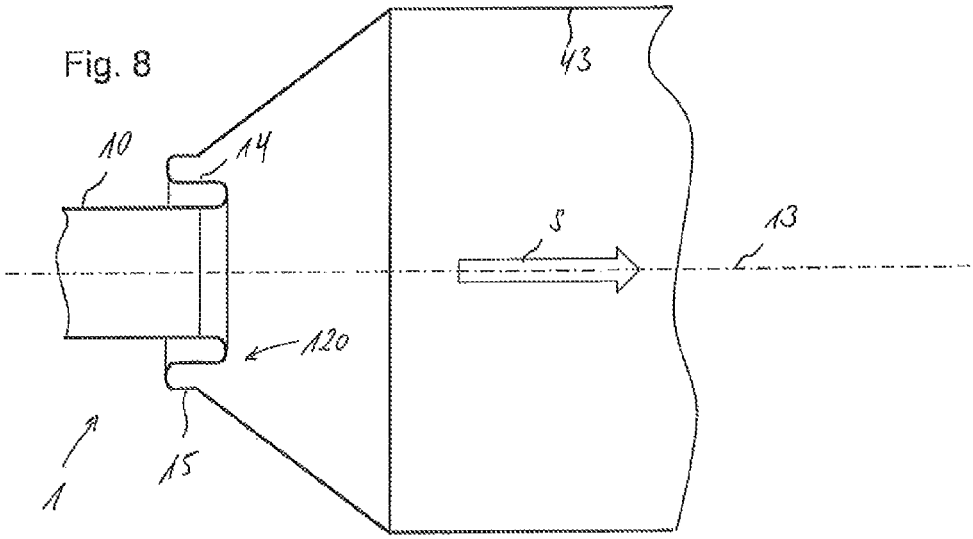
FIG. 8 shows the integration of an insulating element into a cone-shaped end wall of a sheet metal housing.

FIG. 8 shows an embodiment where the sound-absorbing insulating element 1 forms a connection between an exhaust gas pipe 47 and a sheet metal housing 43 with the sheet metal housing 43 having a cone-shaped end wall. Here, too, the larger diameter 151 of the external connecting sleeve 15 when compared to the diameter of the internal connecting sleeve 10 is advantageously accomplished through the connection to the sheet metal housing 43 so that a decrease of the cross-sectional area, of the diameter 152 of the external connecting sleeve 15 to a smaller size is not required.

What is claimed is:

1. An exhaust gas system comprising several components for an internal combustion engine for connection to a manifold comprising: at least one first section as a starting point provided in a direction of flow S and a second section following the first section in the direction of flow with the two sections being interconnected via a mechanical de-coupling element, wherein in the direction of flow S before the mechanical decoupling element a separate single-wall and self-supporting sound-absorbing insulating element is integrated into the exhaust gas system upstream of or within the first section with the sound-absorbing insulating element being provided with at least an internal connecting sleeve and with at least one external connecting sleeve offset to the outside in a direction radial to a central axis, with a central section being provided that is arranged between the two connecting sleeves and connects the two connecting sleeves, with the central section shortened in a length (L) in the direction of the central axis in such a way that a cross-section of the said central section forms a U or S eccentricity.

2. The gas system according to claim 1, wherein the internal connecting sleeve of the insulating element in the direction of the central axis is positioned offset to the external connecting sleeve and/or wherein the two connecting sleeves overlap each other by a size of a push-in depth (e) ranging from 5 mm to 30 mm.

3. The gas system according to claim 1, wherein a basic diameter of the internal connecting sleeve is smaller by at least 20% to maximally 40% than a diameter of the external connecting sleeve.

4. The gas system according to claim 1, wherein the central section of the insulating element which connects the two tube-shaped connecting sleeves is provided with at least one external radius connected at the external connecting sleeve and one internal radius connected at the internal connecting sleeve as well as a pipe length connecting the two radii, with the pipe wall of the pipe length being arranged in parallel to or in an angle a between 2.5° and 15° to the central axis.

5. The gas system according to claim 1, wherein the single-wall sound-absorbing insulating element is made of sheet metal or cast metal and is provided in a direction along the work piece with continuously or discontinuously increasing wall thicknesses ranging from 1 mm to 2.8 mm.

6. The gas system according to claim 1, wherein the sound-absorbing insulating element has in the flow direction S downstream of the internal connecting sleeve a reduced internal diameter when compared to a basic diameter.

7. The gas system according to claim 1, wherein the sound-absorbing insulating element is made of an adjusted pipe length with a basic diameter on the intake side ranging from 45 mm to 85 mm and a diameter on the exhaust side ranging from 55 mm to 115 mm as well as with an absolute length in the direction of the central axis ranging from 230 mm to 420 mm.

8. The gas system according to claim 1, wherein the sound-absorbing insulating element is integrated into an end wall of a sheet metal housing for a particulate filter or a converter or a muffler with at least a part of the end wall connecting in a radial direction to the central axis to the internal connecting sleeve and/or to the external connecting sleeve.

9. The gas system according to claim 1, wherein the sound-absorbing insulating element is positioned at an outlet of a housing for a turbocharger.

10. A method for providing sound-absorbing insulation to an exhaust gas system, comprising the steps of: providing a mechanical de-coupling element for an exhaust gas system for the sound-absorbing insulation of the exhaust gas system within the frequency range from 600 Hz to 6 kHz with a separate sound-absorbing insulating element, located in a direction of flow before the mechanical de-coupling element, being provided with at least one internal connecting sleeve and at least one external connecting sleeve offset to the outside in a direction radial to a central axis, with a central section being provided that is arranged between the two connecting sleeves and connects the two connecting sleeves, with the central section shortened in a length (L) in the direction of the cetral axis in such a way that the cross-section of the said central section forms a U or S eccentricity.

11. The gas system according to claim 5, wherein the wall thickness ranges from 1.2 mm to 1.9 mm.

12. The gas system according to claim 2, wherein the basic diameter of the internal connecting sleeve is smaller by at least 20% to maximally 40% than a diameter of the external connecting sleeve.

13. The gas system according to claim 12, wherein the central section of the insulating element which connects the two tube-shaped connecting sleeves is provided with at least one external radius connected at the external connecting sleeve and one internal radius connected at the internal connecting sleeve as well as a pipe length connecting the two radii, with the pipe wall of the pipe length being arranged in parallel to or in an angle a between 2.5° and 15° to the central axis.

14. The gas system according to claim 13, wherein the single-wall sound-absorbing insulating element is made of sheet metal or cast metal and is provided in a direction along the work piece with continuously or discontinuously increasing wall thicknesses ranging from 1 mm to 2.8 mm.

15. The gas system according to claim 14, wherein the sound-absorbing insulating element has in the flow direction S downstream of the internal connecting sleeve a reduced internal diameter when compared to a basic diameter.

16. The gas system according to claim 15, wherein the sound-absorbing insulating element is made of an adjusted pipe length with a basic diameter on the intake side ranging from 45 mm to 85 mm and a diameter on the exhaust side ranging from 55 mm to 115 mm as well as with an absolute length in the direction of the central axis ranging from 230 mm to 420 mm.

17. The gas system according to claim 16, wherein the sound-absorbing insulating element is integrated into an end wall of a sheet metal housing for a particulate filter or a converter or a muffler with at least a part of the end wall connecting in a radial direction to the central axis to the internal connecting sleeve and/or to the external connecting sleeve.

18. The gas system according to claim 17, wherein the sound-absorbing insulating element is positioned at an outlet of a housing for a turbocharger.

* * * * *